US006640669B2

(12) United States Patent
Izumisawa

(10) Patent No.: US 6,640,669 B2
(45) Date of Patent: Nov. 4, 2003

(54) RATCHET WRENCH

(75) Inventor: Nobuyuki Izumisawa, Itabashi-ku (JP)

(73) Assignee: Kabushiki Kaisha Shinano Seisakusho, Tokyo (JP)

( * ) Notice: Subject to any disclaimer, the term of this patent is extended or adjusted under 35 U.S.C. 154(b) by 0 days.

(21) Appl. No.: 10/208,471

(22) Filed: Jul. 25, 2002

(65) Prior Publication Data

US 2003/0115992 A1 Jun. 26, 2003

(51) Int. Cl.[7] ..... B25B 13/46
(52) U.S. Cl. ..... 81/57.39; 81/62
(58) Field of Search ..... 81/57.39, 57.14, 81/57.3, 57.31, 62, 63, 63.1, 63.2

(56) References Cited

U.S. PATENT DOCUMENTS 4,300,413 A * 11/1981 Garofalo ..... 81/62
4,406,183 A * 9/1983 Wix ..... 81/57.29
4,898,052 A * 2/1990 Kang ..... 81/57.43
5,582,080 A * 12/1996 Barmore ..... 81/63
5,622,089 A * 4/1997 Gifford, Sr. ..... 81/62
5,784,934 A 7/1998 Izumisawa
6,298,753 B1 * 10/2001 Izumisawa ..... 81/57.39

* cited by examiner

*Primary Examiner*—D. S. Meislin
(74) *Attorney, Agent, or Firm*—Jordan and Hamburg LLP

(57) ABSTRACT

In a ratchet wrench, rotation of an output shaft of an air motor is transmitted to a ratchet unit via a reduction gear unit in order to rotate a spindle connected to the ratchet unit, and the ratchet unit is accommodated within a ratchet housing. The ratchet wrench includes a cover plate which covers one face of the ratchet housing opposite the other face thereof from which the spindle projects. A pair of reverse buttons are disposed on the cover plate to be slidable along a direction parallel to an output shaft of the air motor. A pair of reverse arms rotatably are attached to the reverse buttons, each reverse arm being movable together with the corresponding reverse button. The ratchet wrench further includes a reverse gear which the reverse arms engage upon movement of the reverse arms caused by sliding movement of the reverse buttons. The reverse gear is rotated in one direction when one of the reverse arms engages the reverse gear and rotated in the opposite direction when the other reverse arm engages the reverse gear.

5 Claims, 6 Drawing Sheets

RATCHET WRENCH

BACKGROUND OF THE INVENTION

1. Field of the Invention

The present invention relates to a ratchet wrench, and more particularly to a reversible ratchet wrench capable of switching its rotational direction.

2. Background of the Invention

A conventional ratchet unit for a reversible ratchet wrench is disclosed in, for example, Japanese Patent Application Laid-Open (kokai) No. 10-217140.

The ratchet unit is accommodated within the head of the ratchet wrench and has a drive shaft and a ratchet direction selector. The ratchet direction selector is operated by an operator in order to rotate a socket attached to the drive shaft clockwise or counterclockwise about the drive shaft. The drive shaft extends outward from the head in a transverse direction and releasably holds the socket in such a manner that the socket rotates together with the drive shaft in order to fasten or loosen a fastening member such as a nut or bolt.

However, the conventional ratchet direction selector is disposed on the head at the back of the drive shaft, and therefore is located at a position remote from a hand which grips the handle of the ratchet wrench so as to hold the ratchet wrench.

Therefore, when the operator wishes to change the rotational direction of the socket between the clockwise and counterclockwise directions, the operator must rotate the knob of the ratchet direction selector with his other hand (i.e., the hand that does not grip the handle of the ratchet wrench). In other words, the operator must use both hands in order to change the rotational direction of the socket.

In the case in which an operator wishes to loosen a nut or bolt which the operator has fastened, or to fasten a nut or bolt which the operator has loosened, within a narrow space into which the operator can barely insert the ratchet wrench, the operator must remove the ratchet wrench from the space, and then rotate the knob of the ratchet direction selector with both the hands in order to switch the rotational direction of the socket. This deteriorates work efficiency.

SUMMARY OF THE INVENTION

In consideration of the above-described problem of the conventional art, an object of the present invention is to provide a ratchet wrench which enables a user to switch rotational direction of a socket by sole use of one hand which grips the handle of the ratchet wrench.

In order to achieve the above object, the present invention provides a ratchet wrench in which rotation of an output shaft of an air motor is transmitted to a ratchet unit via a reduction gear unit in order to rotate a spindle connected to the ratchet unit, the ratchet unit being accommodated within a ratchet housing, the ratchet wrench comprising a cover plate covering one face of the ratchet housing opposite the other face thereof from which the spindle projects; a pair of reverse buttons disposed on the cover plate to be slidable along a direction parallel to the output shaft of the air motor; a pair of reverse arms rotatably attached to the reverse buttons, each reverse arm being movable together with the corresponding reverse button; and a reverse gear which the reverse arms engage upon movement of the reverse arms caused by sliding movement of the reverse buttons, the reverse gear being rotated in one direction when one of the reverse arms engages the reverse gear and rotated in the opposite direction when the other reverse arm engages the reverse gear.

Preferably, the reverse arms are coupled with first ends of a pair of springs, whose second ends are fixed to the cover plate, the springs urging the reverse arms toward a direction away from the reverse gear; and the reverse arms each have a curved portion which abuts a toll pin fixed to the cover plate.

Preferably, a spring is provided between and connected to the pair of reverse arms in order to urge them to approach each other.

Preferably, each of the reverse arms has a rack at an end portion that engages the reverse gear.

Preferably, the rack is formed in such a manner that the pitch line of the rack inclines with respect to the longitudinal axis of the corresponding reverse arm.

The above-described structure enables a user to switch rotational direction of the spindle through simple operation of sliding the pair of reverse buttons by use of the thumb of a hand which grips the handle of the ratchet wrench. Therefore, the easiness of operation of the ratchet wrench can be improved greatly.

DESCRIPTION OF THE PREFERRED EMBODIMENT

An embodiment of the present invention will be described with reference to the drawings.

Figure 1:
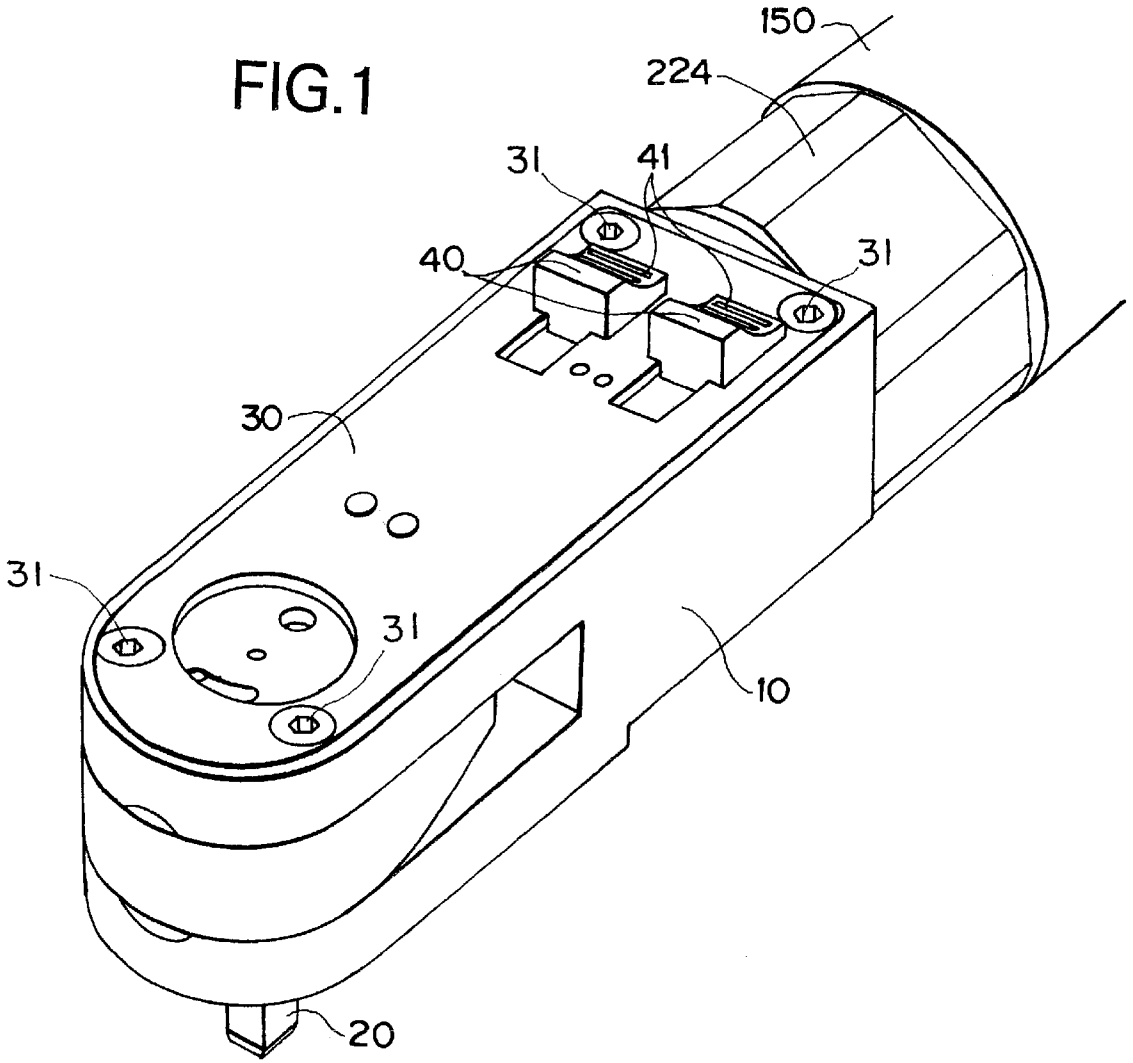
FIG. 1 is a perspective view of a main portion of a ratchet wrench according to an embodiment of the present invention.

In FIG. 1, reference numeral 10 denotes a ratchet housing which accommodates a ratchet unit 221 to be described later; and reference numeral 20 denotes a spindle connected to the ratchet unit 221. The spindle 20 rotates when power supplied from an air motor 110, which will be described later, is transmitted to the ratchet unit 221 via a reduction gear unit 210, which will also be described later.

The spindle 20 projects from a front face of the ratchet housing 10, and a rear face of the ratchet housing 10 opposite the front face is covered with a cover plate 30. The cover plate 30 is a substantially rectangular plate, and a portion of the cover plate 30 corresponding to the spindle 20 is formed into a semi-circular shape. The four corners of the cover plate 30 are fixed to the ratchet housing 10 by use of screws 31.

Figure 2:
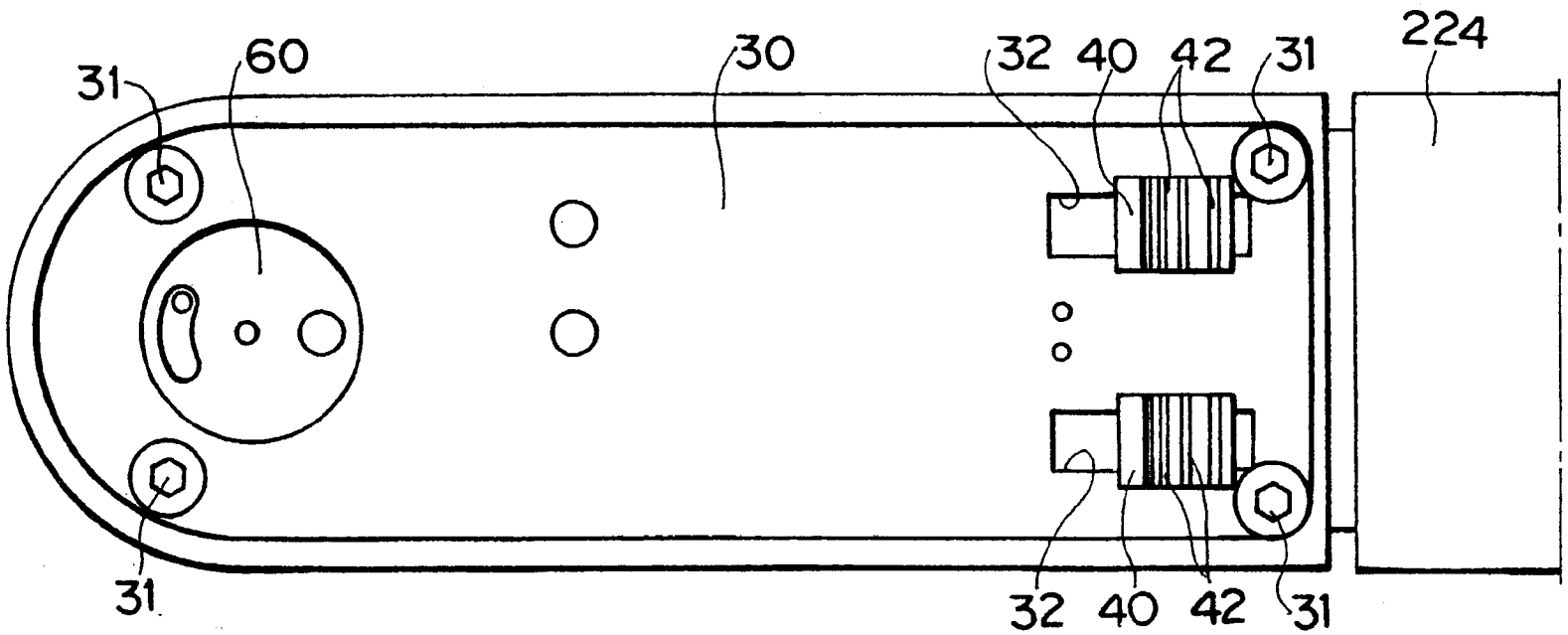
FIG. 2 is a plan view of the main portion shown in FIG. 1.

Further, as shown in FIG. 2, a pair of rectangular holes 32 are formed in the cover plate 30, at a side in proximity to the air motor 110. A pair of reverse buttons 40 are disposed within the rectangular holes 32 in such a manner that the reverse buttons 40 can be slid along a direction parallel to an output shaft 190 of the air motor 110. The reverse buttons 40 have curved surfaces 41, on which a plurality of ridges 42 are formed in order to facilitate the operation of sliding the reverse buttons 40 by sole use of the thumb of one hand which grips the handle (a portion corresponding to a motor housing 150) of the ratchet wrench.

Figure 3:
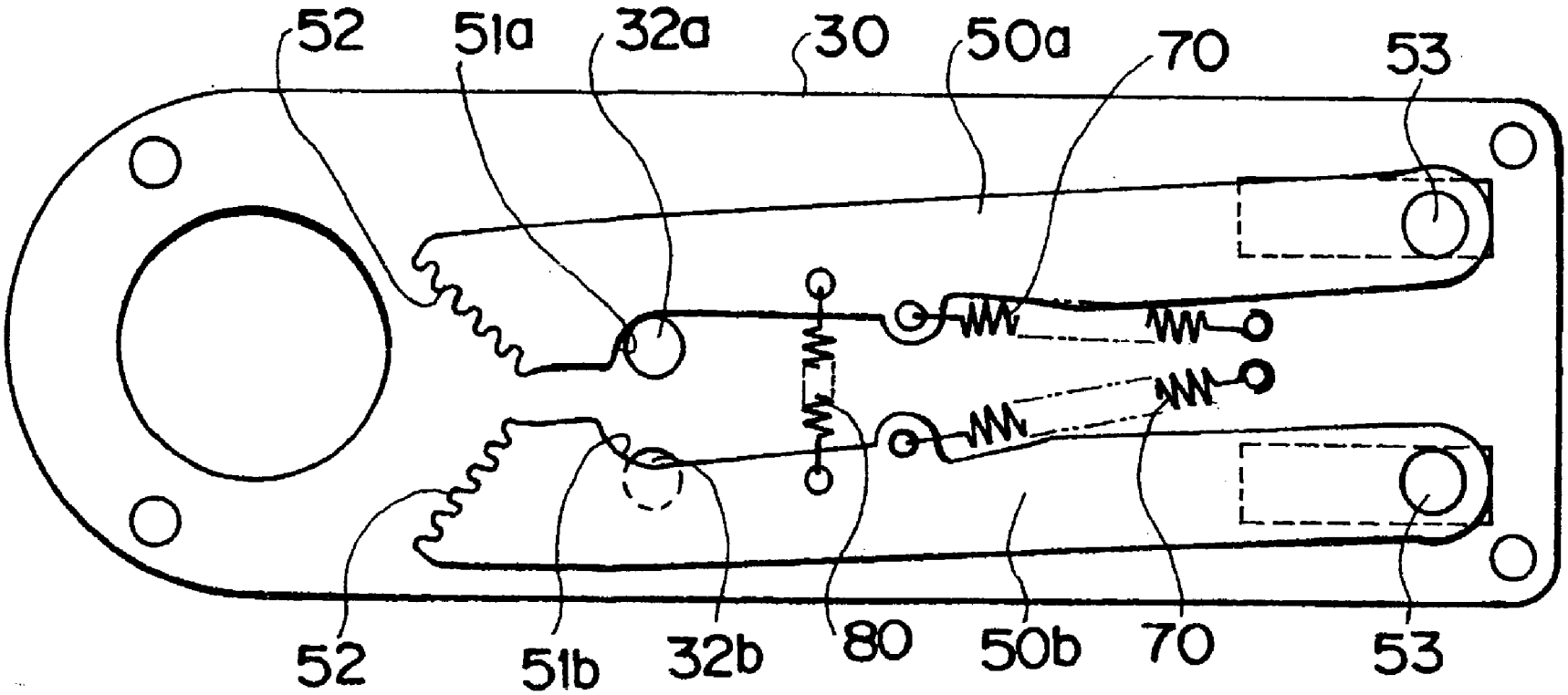
FIG. 3 is a back-side view of a cover plate which constitutes the ratchet wrench of FIG. 1.
Figure 4:
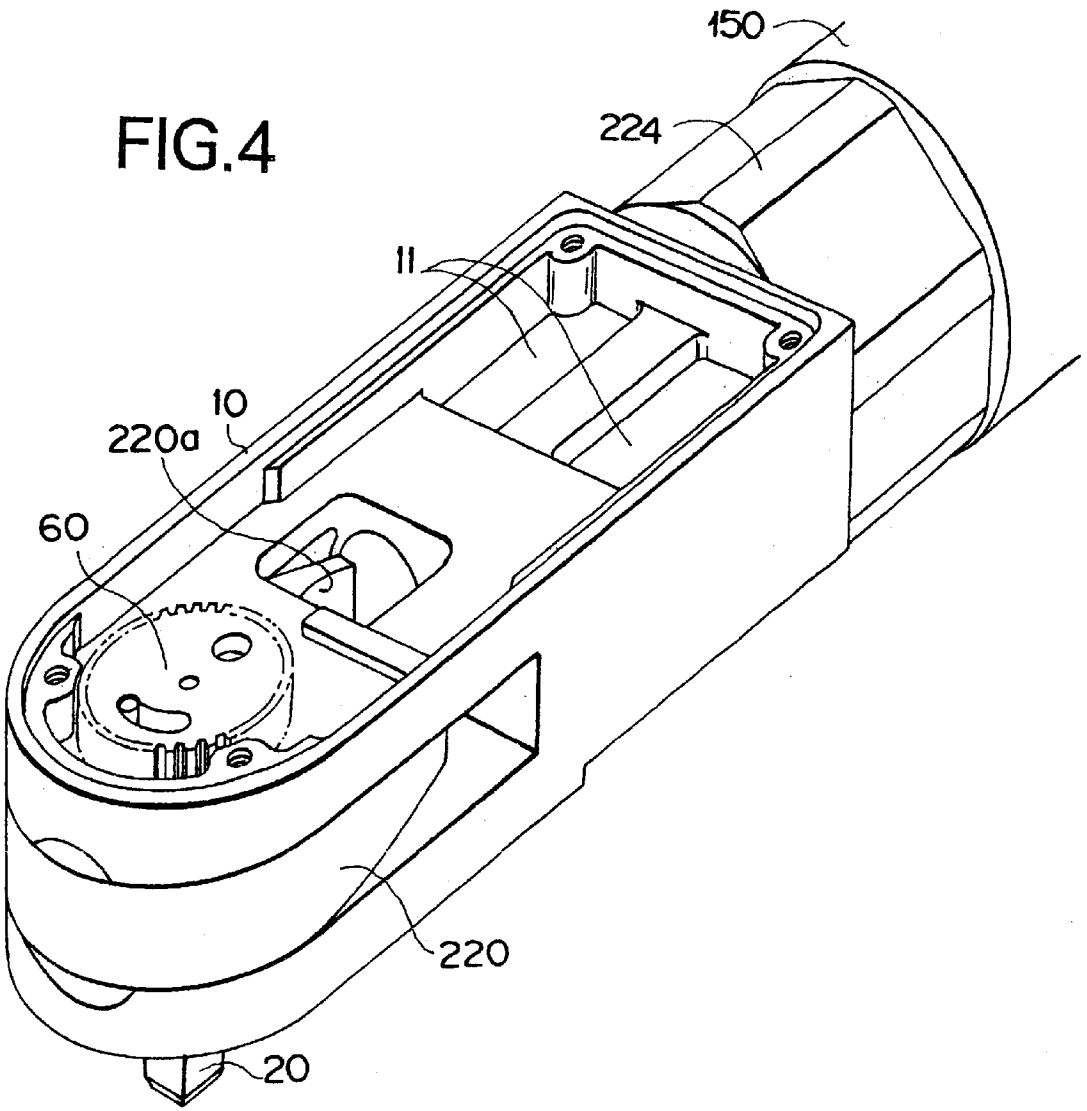
FIG. 4 is a perspective view of a ratchet housing which constitutes the ratchet wrench of FIG. 1.

As shown in FIG. 3, a pair of reverse arms 50*a* and 50*b*, together with collars 53, are rotatably attached to the reverse faces of the reverse buttons 40 opposite the curved surfaces 41. The reverse arms 50*a* and 50*b* are disposed on the reverse face of the cover plate 30 in such a manner that the reverse arms 50*a* and 50*b* can reciprocate longitudinally. The collars 53 are accommodated within rectangular grooves 11 (shown in FIG. 4) formed in the ratchet housing 10.

A reverse gear 60 is disposed on the ratchet housing 10. When the reverse arms 50*a* and 50*b* are advanced alternately, the advanced one of the reverse arms 50*a* and 50*b* comes into engagement with the reverse gear 60 and rotates the reverse gear 60 in the corresponding direction. Specifically, in an ordinary state, the two reverse arms 50*a* and 50*b* are separated from the reverse gear 60. However, when an operator pushes and slides one of the reverse buttons 40 toward the reverse gear 60 with his thumb, the corresponding reverse arm 50*a* or 50*b* is advanced toward the reverse gear 60. As a result, the reverse arm 50*a* or 50*b* engages and rotates the reverse gear 60.

The reverse arms 50*a* and 50*b* are coupled with first ends of a pair of springs 70, whose second ends are fixed to the cover plate 30. The springs 70 urge the reverse arms 50*a* and 50*b* toward a direction away from the reverse gear 60. Accordingly, when the operator releases his thumb from the advanced reverse button 40 after having rotated the reverse gear 60, the corresponding reverse arm 50*a* or 50*b* is disengaged from the reverse gear 60 by the action of the corresponding spring 70.

One reverse arm 50*a* has a curved portion 51*a*, which abuts a toll pin 32*a* fixed to the cover plate 30, and is slid in contact with the cover plate 30. The other reverse arm 50*b* is slid in contact with a short pin 32*b* fixed to the cover plate 30, and has a curved portion 51*b*, which abuts the toll pin 32*a*. A spring 80 is provided between and connected to the pair of reverse arms 50*a* and 50*b* in order to urge them to approach each other. By virtue of the spring 80, when the reverse arm 50*a* or 50*b* is disengaged from the reverse gear 60 by the action of the corresponding spring 70, the reverse arm 50*a* or 50*b* moves toward the toll pin 32*a* and stops at the position of the toll pin 32*a* in a state in which the reverse arms 50*a* and 50*b* overlap each other.

Each of the reverse arms 50*a* and 50*b* has a rack 52 at an end portion that engages the reverse gear 60. The rack 52 is formed in such a manner that the pitch line of the rack 52 inclines with respect to the longitudinal axis of the corresponding reverse arm 50*a* or 50*b*. In the present embodiment, the reverse arms 50*a* and 50*b* have the same shape; however, as shown in FIG. 3, the reverse arms 50*a* and 50*b* are attached to the cover plate 30 such that one of them is inverted.

Figure 5:
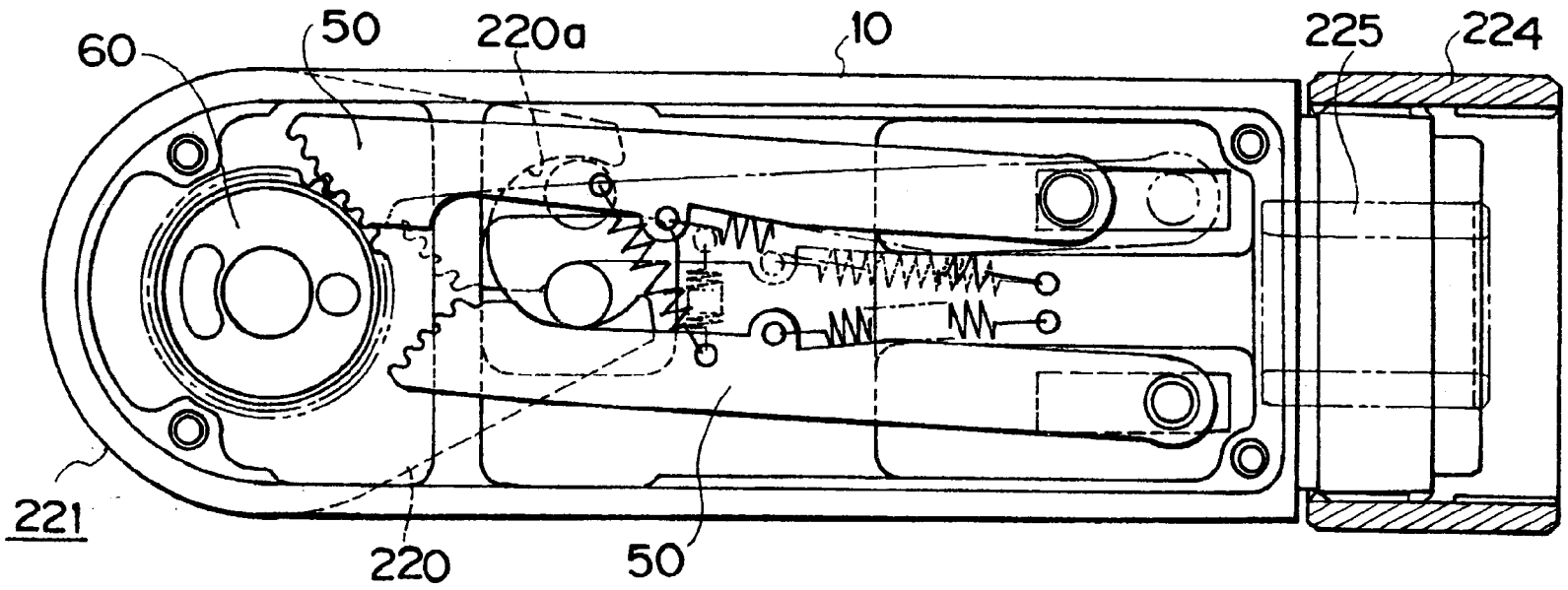
FIG. 5 is a plan view showing the internal mechanism of the ratchet wrench of FIG. 1.
Figure 6:
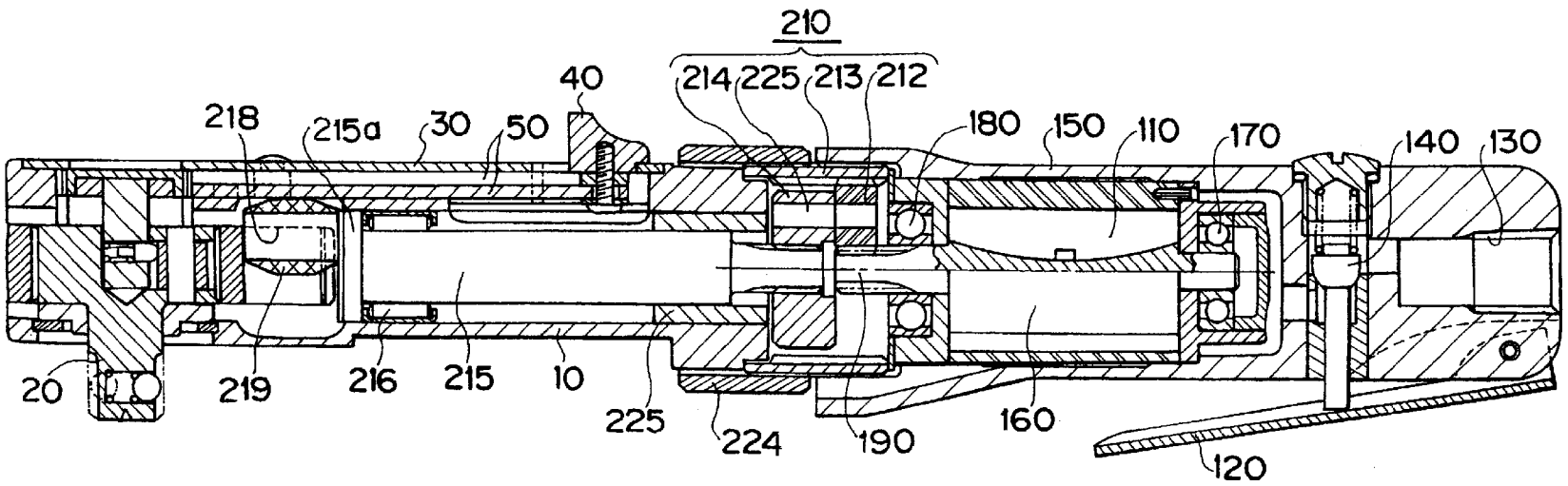
FIG. 6 is a vertical cross-sectional view of the ratchet wrench of FIG. 1.

As shown in FIGS. 5 and 6, the air motor 110 is accommodated in the motor housing 150. Upon operation of an open-close lever 120, pressurized air is fed from an air induction port 130 to the air motor 110 via an open-close valve 140, so that a rotor 160 of the air motor 110 rotates and thus the output shaft 190 connected to the rotor 160 rotates. Notably, the motor housing 150 serves as a grip; i.e., a handle of the ratchet wrench.

In the air motor 110, the rotor 160 is rotatably supported by bearings 170 and 180 fixed to the motor housing 150. The output shaft 190 is rotatably supported by the bearing 180. The tip end of the output shaft 190 is in engagement with the reduction gear unit 210.

The reduction gear unit 210 includes three idle gears. 212, an internal gear 213, and a cage 214. The idle gears 212 are in meshing-engagement with the output shaft 190. The internal gear 213 is in meshing-engagement with the idle gears 212 and is fixed to the ratchet housing 10, which is coupled with the motor housing 150 by way of a lock ring 224. The cage 214 is coupled with each of the idle gears 212 via a respective idle pin 225 and is in engagement with a crankshaft 215.

The three idle gears 212 are disposed around the output shaft 190. Each of the idle gears 212 is rotatably fixed onto the corresponding idle pin 225. The cage 214 is fixed to the idle pins 225 (three idle pins in the embodiment of FIG. 6), so that, when the idle gears 212 revolve around the output shaft 190, the cage 214 rotates about its axis, and the crankshaft 215 rotates.

In the ratchet housing 10, the crankshaft 215 is rotatably supported by a bush 225 on the side of the reduction gear unit 210 and a needle bearing 216 on the side of the spindle 20.

The crankshaft 215 has a crank pin 218 projecting from a tip end surface 215a at an eccentric position. The crank pin 218 is rotatably connected to a bush 219, which is rotatably fitted in a recess 220*a* of a yoke 220. The yoke 220 is connected to the spindle 20 via the ratchet unit 221.

When an object, such as a bolt or nut, is tightened by use of the ratchet wrench having the above-described structure; an unillustrated socket attached to the spindle 20 is engaged with the object, and the open-close lever 120 is operated. As a result, the air motor 110 operates, and the output shaft 190 rotates together with the rotor 160.

The rotation speed of the output shaft 190 is reduced through the reduction gear unit 210. Rotational motion of the output shaft 190 is transmitted to the crankshaft 215 and is converted to swing motion by the action of the crank pin 218. The swing motion is then transmitted to the yoke 220, so that the yoke 220 swings repeatedly. The swinging motion of the yoke 220 is converted to rotary motion of the spindle 20 by the ratchet unit 221, whereby the bolt or nut is tightened. When the bolt or nut is to be loosened, the operator rotates the reverse gear 60 in the corresponding direction through operation of the corresponding reverse button 40 to thereby change the rotational direction of the spindle 20.

What is claimed is:

1. A ratchet wrench in which rotation of an output shaft of an air motor is transmitted to a ratchet unit via a reduction gear unit in order to rotate a spindle connected to the ratchet unit, the ratchet unit being accommodated within a ratchet housing, the ratchet wrench comprising:

a cover plate covering one face of the ratchet housing opposite the other face thereof from which the spindle projects;

a pair of reverse buttons disposed on the cover plate to be slidable along a direction parallel to the output shaft of the air motor;

a pair of reverse arms rotatably attached to the reverse buttons, each reverse arm being movable together with the corresponding reverse button; and a reverse gear which the reverse arms engage upon movement of the reverse arms caused by sliding movement of the reverse buttons, the reverse gear being rotated in one direction when one of the reverse arms engages the reverse gear and rotated in the opposite direction when the other reverse arm engages the reverse gear.

2. A ratchet wrench according to claim 1, wherein the reverse arms are coupled with first ends of a pair of springs, whose second ends are fixed to the cover plate, the springs urging the reverse arms toward a direction away from the reverse gear; and the reverse arms each have a curved portion which abuts a toll pin fixed to the cover plate.

3. A ratchet wrench according to claim 2, wherein a spring is provided between and connected to the pair of reverse arms in order to urge them to approach each other.

4. A ratchet wrench according to claim 1, wherein each of the reverse arms has a rack at an end portion that engages the reverse gear.

5. A ratchet wrench according to claim 4, wherein the rack is formed in such a manner that the pitch line of the rack inclines with respect to the longitudinal axis of the corresponding reverse arm.

* * * * *